US009080275B2

(12) United States Patent
Park et al.

(10) Patent No.: US 9,080,275 B2
(45) Date of Patent: Jul. 14, 2015

(54) DRAIN HOSE AND WASHING MACHINE HAVING THE SAME

(75) Inventors: Young Pil Park, Gyeonggi-do (KR); Sung Soo Park, Seoul (KR); Shin Wook Kang, Suwon-si (KR); Jin Doo Kim, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 592 days.

(21) Appl. No.: 13/468,540

(22) Filed: May 10, 2012

(65) Prior Publication Data

US 2012/0291498 A1 Nov. 22, 2012

(30) Foreign Application Priority Data

May 18, 2011 (KR) ..... 10-2011-0046995

(51) Int. Cl.
*D06F 39/08* (2006.01)

(52) U.S. Cl.
CPC ..... *D06F 39/083* (2013.01); *D06F 39/08* (2013.01); *D06F 39/085* (2013.01); *D06F 2204/084* (2013.01)

(58) Field of Classification Search
CPC . D06F 39/08; D06F 39/083; D06F 2204/084; D06F 39/085
USPC ..... 68/208; 134/56 D, 57 D, 58 D, 111, 184
See application file for complete search history.

(56) References Cited

U.S. PATENT DOCUMENTS

| | | | | |
|---|---|---|---|---|
| 2,817,130 | A | 12/1957 | Roberts et al. | |
| 2,922,526 | A | 1/1960 | Ohmann | |
| 2,983,130 | A * | 5/1961 | Pinder | 68/18 R |
| 2,986,913 | A * | 6/1961 | Condit et al. | 68/12.02 |
| 3,012,429 | A * | 12/1961 | Evjen | 68/23.4 |
| 3,568,789 | A * | 3/1971 | Guth | 181/211 |
| 3,889,697 | A | 6/1975 | Guth | |
| 3,954,116 | A | 5/1976 | Guth et al. | |
| 4,696,171 | A * | 9/1987 | Babuin | 68/207 |
| 5,975,846 | A * | 11/1999 | Wistinghausen | 415/206 |
| 6,470,716 | B1 * | 10/2002 | Ozturk | 68/208 |
| 2006/0191301 | A1 * | 8/2006 | Park et al. | 68/140 |

FOREIGN PATENT DOCUMENTS

| | | |
|---|---|---|
| DE | 27 12 093 | 9/1978 |
| DE | 197 52 296 | 5/1999 |

(Continued)

OTHER PUBLICATIONS

PCT International Search Report mailed Nov. 23, 2012, issued in corresponding International Application No. PCT/KR2012/003712.

(Continued)

*Primary Examiner* — Joseph L Perrin
(74) *Attorney, Agent, or Firm* — Staas & Halsey LLP

(57) ABSTRACT

A washing machine capable of reducing noise generated during a drain operation or a spin dry operation with a simple structure. The washing machine includes a cabinet, a tub disposed inside the cabinet to accommodate wash water, a drain pump disposed at a lower side of the tub to drain the wash water contained in the tub, a first drain hose connecting the tub to the drain pump to allow the wash water contained in the tub to be introduced into the drain pump, and a second drain hose guiding the wash water, which is introduced into the drain pump, to outside the cabinet.

18 Claims, 13 Drawing Sheets

(56) References Cited

FOREIGN PATENT DOCUMENTS

| | | | |
|---|---|---|---|
| DE | 201 13 228 | | 10/2001 |
| EP | 1956263 | A1 * | 8/2008 |
| EP | 2 267 211 | A1 | 12/2010 |
| JP | 50-83846 | | 7/1975 |
| JP | 62-101495 | | 6/1987 |
| JP | 3-177692 | | 8/1991 |
| JP | 2003-113990 | | 4/2003 |
| KR | 1999-0019297 | | 6/1999 |
| KR | 10-2001-0070620 | | 7/2001 |
| KR | 10-2008-0071542 | A | 7/2001 |
| KR | 10-2007-0014712 | | 2/2007 |

OTHER PUBLICATIONS

Extended European Search Report issued Aug. 13, 2013 in corresponding European Patent Application No. 12 16 6408.

* cited by examiner

DRAIN HOSE AND WASHING MACHINE HAVING THE SAME

CROSS-REFERENCE TO RELATED APPLICATIONS

This application claims the benefit of Korean Patent Application No. 2011-0046995, filed on May 18, 2011 in the Korean Intellectual Property Office, the disclosure of which is incorporated herein by reference.

BACKGROUND

1. Field

Embodiments of the present disclosure relate to a drain hose used to drain wash water and a washing machine having the same.

2. Description of the Related Art

A washing machine is provided with a tub, a rotary tub accommodating a laundry, such as clothes, inside the tub, and a motor to drive the rotary tub. The washing machine performs a series of operations including a washing operation, a rinsing operation, and a spin-dry operation.

The wash water having been used during the washing operation or the rinsing operation is pumped out by a drain pump and forcedly drained to the outside the washing machine. In addition, during the spin-dry operation, water separated from the laundry is introduced to the drain pump and then is discharged to the outside the washing machine.

In general, a drain hose is provided between the tub and the drain pump to connecting the tub to the drain pump.

The wash water drained after being used during the washing or rinsing operation or the wash water separated from the laundry during the spin-dry operation flows into the drain hose at a lower side of the tub and then is mixed with air inside the drain hose. If wash water with air mixed flows through inside the drain hose, cavitation occurs. The cavitation prevents the wash water from smoothly flowing or causes a turbulence that generates abnormal noise.

SUMMARY

Therefore, it is an aspect of the present disclosure to provide a drain hose capable of reducing noise that is generated during a drain operation or a spin-dry operation with a simple structure, and a washing machine having the same.

It is another aspect of the present disclosure to provide a drain hose enabling the wash water to smoothly flow inside the drain hose, and a washing machine having the same.

Additional aspects of the disclosure will be set forth in part in the description which follows and, in part, will be apparent from the description, or may be learned by practice of the disclosure.

In accordance with one aspect of the present disclosure, a washing machine includes a cabinet, a tub, a drain pump, a first drain hose, and a second drain hose. The tub is disposed inside the cabinet to accommodate wash water. The drain pump is disposed at a lower side of the tub to drain the wash water contained in the tub. The first drain hose connects the tub to the drain pump to allow the wash water contained in the tub to be introduced into the drain pump. The second drain hose guides the wash water, which is introduced into the drain pump, to outside the cabinet. The first drain hose includes a passage allowing wash water and air to pass therethrough, and a cross section reducing part configured to reduce a cross section of the passage to disturb a flow of the air passing through the passage.

The first drain hose is provided at an inner side with a wash water passage, which allows the wash water contained in the tub to be introduced thereinto and flow therethrough, and an air passage, which is formed at an upper side of the wash water passage to allow air contained in the tub or the drain pump to be introduced thereinto and flow therethrough. The cross section reducing part divides the air passage into at least two separate spaces.

The air passage includes a first air passage and a second air passage. The first air passage allows the air contained in the tub to be introduced thereinto. The second air passage allows the air contained in the drain pump to be introduced thereinto. The cross section reducing part blocks the first air passage from the second air passage to prevent the first air passage from communicating with the second air passage.

A portion of the first drain hose, on which the cross section reducing part is formed, has a cross section horizontally asymmetric with respect to a center line, which passes through a center of a cross section of a remaining portion of the first drain hose in parallel to a ground.

The first drain hose includes a first connection part connected to the tub, and a second connection part connected to the drain pump. The cross section reducing part is formed at a position nearer to the second connection part than the first connection part.

The first drain hose further includes a wrinkled part provided between the first connection part and the second connection part. The cross section reducing part is formed between the wrinkled part and the second connection part.

The cross section reducing part has a concave form obtained by concaving a portion of an upper side of the first drain hose, which is divided in symmetric to a lower side of the first drain hose with respect to a curved surface, in a radial direction of the first drain hose.

The cross section reducing part includes a planar surface having a constant height such that the first air passage and the second air passage are stably divided by the cross section reducing part.

The height of the planar surface is one fourth or greater and three fourths or less of a diameter of the second connection part.

The cross section reducing part is provided as a partition that extends downward from an inner circumferential surface of an upper side of the first drain hose, which is divided in symmetric to a lower side of the first drain hose with respect to a curved surface.

The cross section reducing part includes a planar surface maintaining a constant height such that the first air passage and the second air passage are stably divided by the cross section reducing part.

The height of the planar surface is one fourth or greater and three fourths or less of a diameter of the second connection part.

The washing machine further includes a clamp which is coupled to an outer circumferential surface of the second connection part to apply a pressing force, so that an inner circumferential surface of the second connection part is pressed against an outer circumferential surface of one end of the drain pump while coming into close contact with the outer circumferential surface of the one end of the drain pump. The clamp includes a handle part, a coil part and an extension part. The handle part is provided with a pressing surface which is pressed by an external force. The coil part is connected to the handle part to press the second connection part in a radial direction of the first drain hose. The extension part extends from one end of the coil part in a tangential direction of the coil part.

The coil part has a diameter which increases as a pressing force is applied to the handle part and decreases as a pressing force is released from the handle part.

In accordance with another aspect of the present disclosure, a washing machine includes a cabinet, a tub disposed inside the cabinet, a drain pump disposed at a lower side of the tub, and a drain hose connecting the tub to the drain pump. The drain hose includes a first connection part, a second connection part and a groove part. The first connection part is connected to the tub and has a first diameter. The second connection part is connected to the drain pump and has a second diameter. The groove part is provided in a form of a concave obtained by concaving a portion of an upper side of the drain hose with respect to a curved surface, which connects the first diameter to the second diameter, to an inner side of the drain hose.

A cross section of a portion of the drain hose, in which the groove part is formed, is asymmetric with respect to the curved surface.

The groove part includes a first inclined surface, a second inclined surface and a planar surface. The first inclined surface is formed in an inclined manner to abruptly decrease a cross section of the drain hose. The second inclined surface is formed in an inclined manner to abruptly increase a cross section of the drain hose. The planar surface is formed between the first inclined surface and the second inclined surface while keeping a height constant.

The drain hose includes a first connection part connected to the tub and a second connection part connected to the drain pump. The height of the planar surface is one fourth or greater and three fourths or less of a diameter of the second connection part.

The groove part is formed at a position nearer to the second connection part than the first connection part.

The drain hose further includes a wrinkled part provided between the first connection part and the second connection part. The groove part is formed between the wrinkled part and the second connection part.

The drain hose has a diameter gradually decreasing from the first connection part to the second connection part.

In accordance with another aspect of the present disclosure, a washing machine includes a cabinet, a tub, a drain pump, and a drain hose. The tub is disposed inside the cabinet to accommodate wash water. The drain pump is disposed at a lower side of the tub to drain the wash water contained in the tub. The drain hose connects the tub to the drain pump such that the wash water contained in the tub is introduced to the drain pump. The drain hose includes a first terminal, a second terminal and a groove part. The first terminal is connected to the tub and has a first cross section. The second terminal is connected to the drain terminal and has a second cross section. The groove part is formed inward of the drain hose to have a cross section smaller than the second cross section.

The groove part is formed at an upper stream side of the second terminal.

In accordance with another aspect of the present disclosure, a washing machine includes a cabinet, a tub, a drain pump, a first drain hose, and a second drain hose. The tub is disposed inside the cabinet to accommodate wash water. The drain pump is disposed at a lower side of the tub to drain the wash water contained in the tub. The first drain hose connects the tub to the drain pump to allow the wash water contained in the tub to be introduced into the drain pump. The second drain hose guides the wash water, which is introduced into the drain pump, to outside the cabinet. The first drain hose further includes a blocking part configured to block a flow of air introduced from the tub to the first drain hose or a flow of air introduced from the drain pump to the first drain hose.

According to the present disclosure, the air inside the drain hose is accommodated in at least two spaces that are separated from each other, so that abnormal noised is reduced during the drain operation or the spin dry operation.

In addition, the wash water smoothly flows inside the drain hose, thereby enhancing the drain efficiency.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
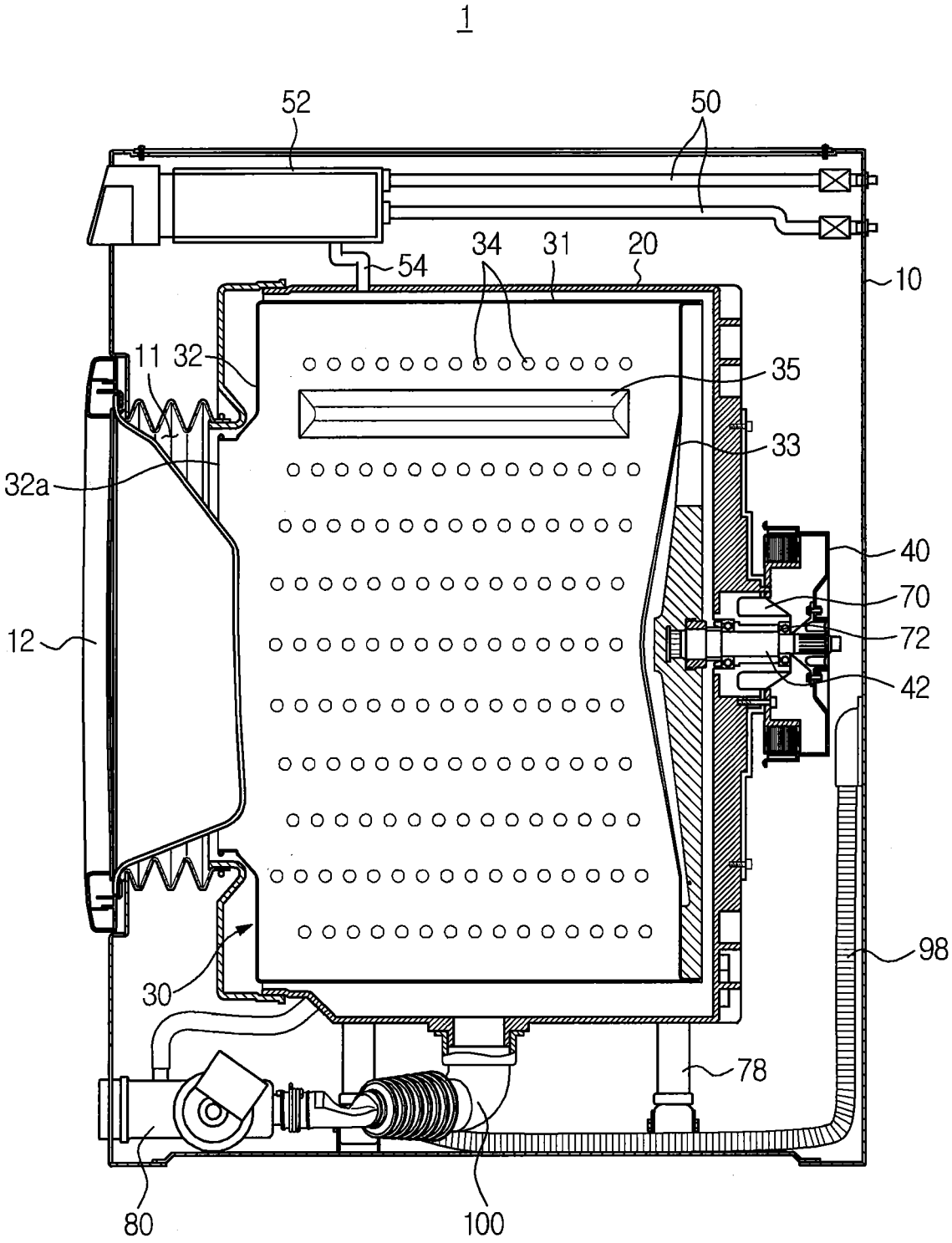
FIG. 1 is a view illustrating the configuration of a washing machine having a drain hose mounted thereon according to an embodiment of the present disclosure.

Reference will now be made in detail to the embodiments of the present disclosure, examples of which are illustrated in the accompanying drawings, wherein like reference numerals refer to like elements throughout.

Figure 2:
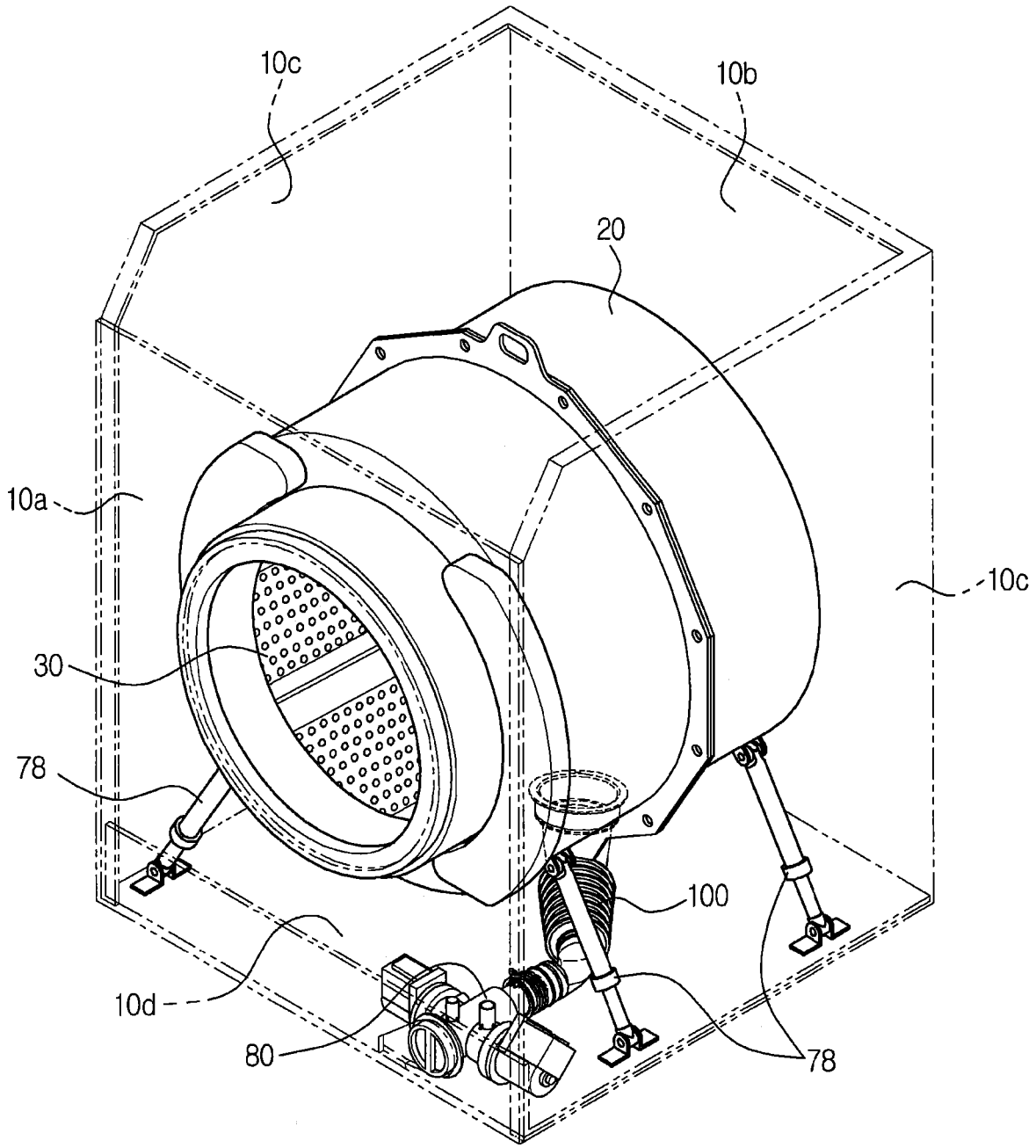
FIG. 2 is a perspective view illustrating a tub, a drain pump, and a drain hose of the FIG. 1.

FIG. 1 is a view illustrating the configuration of a washing machine having a drain hose mounted thereon according to an embodiment of the present disclosure. FIG. 2 is a perspective view illustrating a tub, a drain pump, and a drain hose of the FIG. 1.

Referring to FIGS. 1 and 2, a washing machine 1 includes a cabinet 10 forming an external appearance of the washing machine 1, a tub 20 disposed inside the cabinet 10, a rotary tub 30 rotatably disposed inside the tub 20, and a motor 40 to drive the rotary tub 30.

The cabinet 10 includes a front frame 10*a*, a rear frame 10*b*, a side frame 10*c*, and a bottom frame 10*d*. The front frame 10*a* and the rear frame 10*b* form a front surface and a rear surface of the cabinet 10, respectively. The side frame 10*c* and the bottom frame 10*d* are configured to connect the front frame 10*a* to the rear frame 10*b* while forming a lateral side and a bottom surface of the cabinet 10, respectively.

The cabinet 10 is provided at a front side thereof with a laundry input port 11 allowing a laundry to be loaded into the rotary tub 30 therethrough. The laundry input port 11 is open and closed by a door 12 that is installed on the front side of the cabinet 10.

A water supply pipe 50 is installed at an upper side of the tub 20 to supply the tub 20 with wash water. One end of the water supply pipe 50 is connected to an external water source (not shown), and the opposite end of the water supply pipe 50 is connected to a detergent dispensing apparatus 52.

The detergent dispensing apparatus 52 is connected to the tub 20 through a connection pipe 54. The water supplied through the water supply pipe 50 is provided to the inside the tub 20 together with detergent via the detergent dispensing apparatus 52.

The tub 20 is supported by a damper 78. The damper 78 connects an inner bottom surface of the cabinet 10 to, an outer surface of the tub 20.

The rotary tub 30 includes a cylindrical part 31, a front plate 32 disposed at a front side of the cylindrical part 31, and a rear plate 33 disposed at a rear side of the cylindrical part 31. The front plate 32 has an opening 32*a* that allows a laundry to be loaded and unloaded therethrough. The rear plate 33 is connected to a driving shaft 42 used to transfer a power of the motor 40.

A plurality of through holes 34 are formed through the circumference of the rotary tub 30. A plurality of lifters 35 is installed on an inner circumferential surface of the rotary tub 30 to enable a rise and fall of a laundry during the rotation of the rotary tub 30.

The driving shaft 42 is disposed between the rotary tub 30 and the motor 40. One end of the driving shaft 42 is connected to the rear plate 33 of the rotary tub 30, and the opposite end of the driving shaft 42 extends to outside a rear side wall of the tub 20. As the motor 40 drives the driving shaft 42, the rotary tub 30 connected to the driving shaft 42 rotates on the driving shaft 42.

A bearing housing 70 is installed on the rear side wall of the tub 20 to rotatably support the driving shaft 42. The bearing housing 70 includes an aluminum alloy. The bearing housing 70 may be inserted into the rear side wall of the tub 20 when the tub 20 is formed through an injection molding. Bearings 72 are installed between the bearing housing 70 and the driving shaft 42 to enable smooth rotation of the driving shaft 42.

A drain pump 80, a drain hose 100, and a guide hose 98 are provided at a lower side of the tub 20. The drain pump 80 discharges the water contained in the tub 20 to outside the cabinet 10. The drain hose 100 connects the tub 20 to the drain pump 80 such that the water contained in the tub 20 is introduced to the drain pump 80. The guide hose 98 guides the water, which is pumped out by the drain pump 80, to the outside the cabinet 10.

Hereinafter, the shape and the operation mechanism of a drain hose according to embodiments of the present disclosure will be described.

Figure 3:
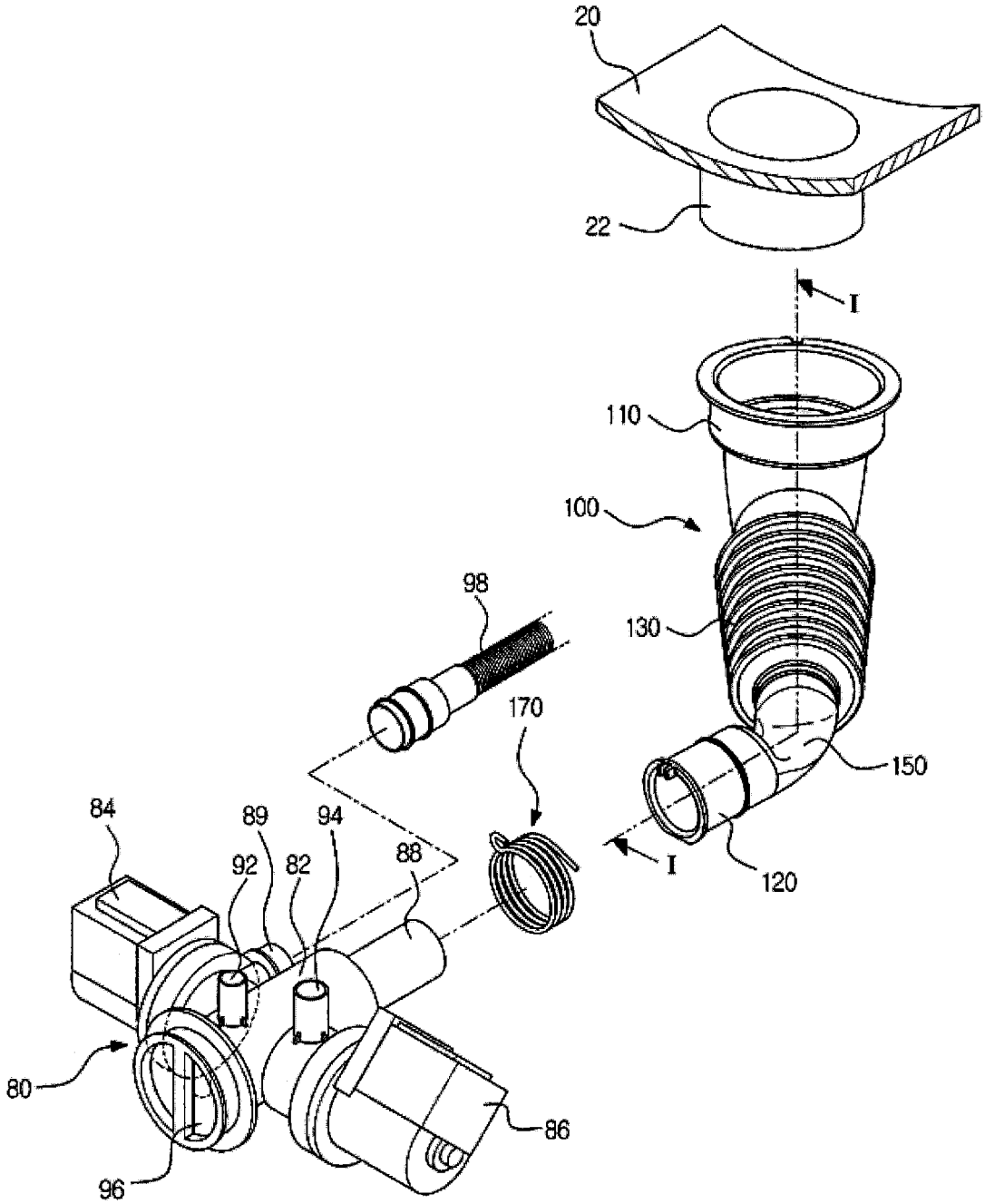
FIG. 3 is an exploded perspective view illustrating the drain pump and the drain hose of FIG. 2.
Figure 4:
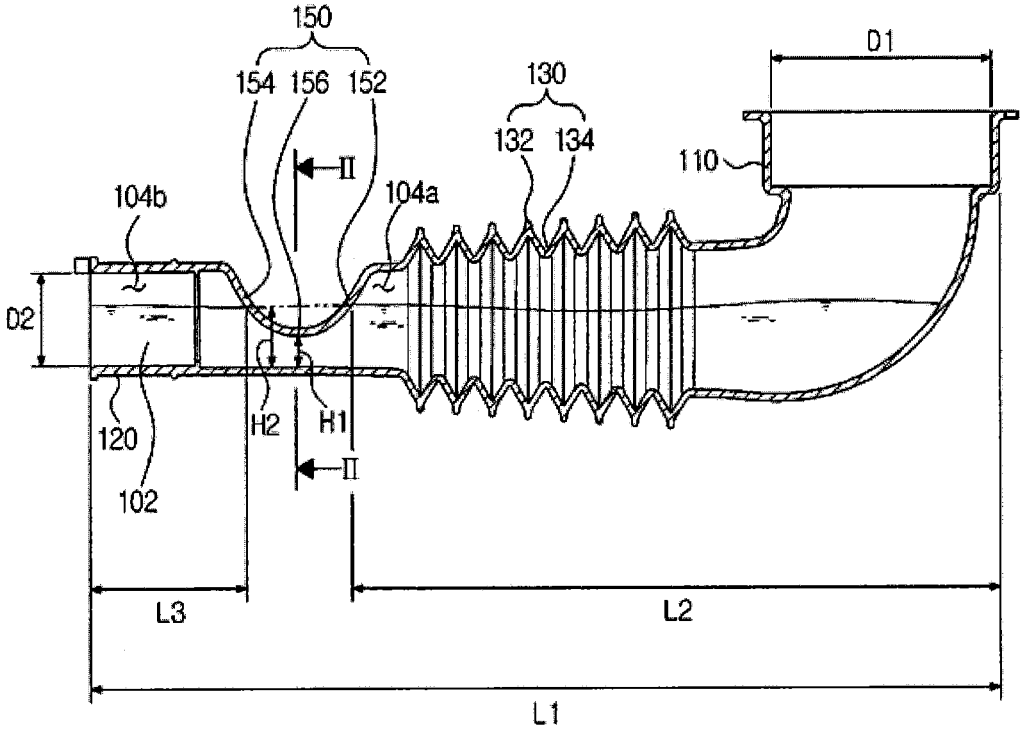
FIG. 4 is a cross-sectional view taken along line I-I of FIG. 3.
Figure 5:
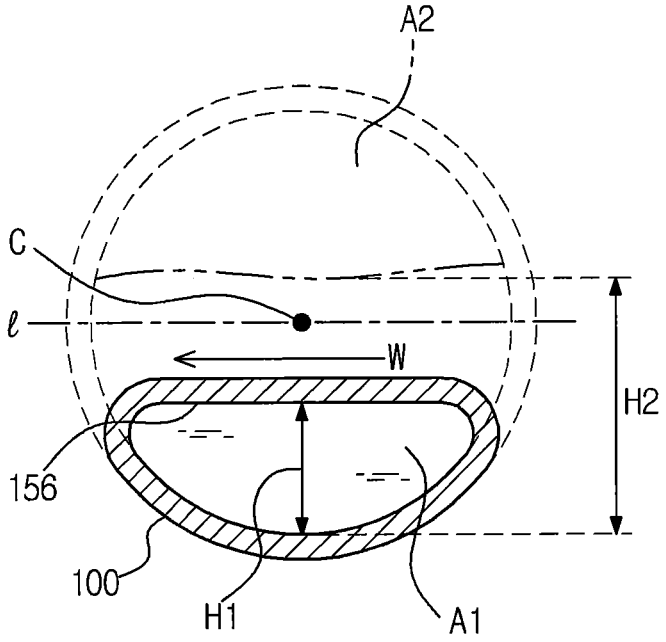
FIG. 5 is a cross-sectional view taken along line II-II of FIG. 4.

FIG. 3 is an exploded perspective view illustrating the drain pump and the drain hose of FIG. 2. FIG. 4 is a cross-sectional view taken along line I-I of FIG. 3. FIG. 5 is a cross-sectional view taken along line II-II of FIG. 4.

Referring to FIGS. 2 to 5, the lower side of the tub 20 is connected to the drain pump 80 through the drain hose 100. The wash water contained in the tub 20 is introduced into the drain pump 80 by passing through the drain hose 100.

The drain pump 80' includes a pump case 82, a drain motor 84, and a bubble generating motor 86. The pump case 82 accommodates the wash water. The drain motor 84 is coupled to one end of the pump case 82 to provide a power for forcedly draining the wash water, which is introduced into the pump case 82. The bubble generating motor 86 generates bubbles in the wash water in the course of circulating the wash water, which is contained in the pump case 82, to the inside the tub 20.

The pump case 82 includes a wash water inlet port 88, a wash water outlet port 89, an air outlet port 92, and a wash water circulation portion 94. The wash water inlet port 88 allows the wash water contained in the tub 20 to be introduced therethrough. The wash water outlet port 89 allows the wash water introduced into the pump case 82 to be discharged therethrough. The air outlet port 92 allows the air contained in the pump case 82 to be discharged therethrough. The wash water circulation port 94 guides the wash water to be circulated back into the tub 20.

The wash water inlet port 88 is connected to the tub 20 through the drain hose 100 to allow the wash water contained in the tub 20 to be introduced into the inside the pump case 82. The wash water outlet port 89 allows the wash water contained in the pump case 82 to be discharged to the outside the cabinet 10 through the guide hose 98. The air outlet port 92 allows the air, which is introduced into the pump case 82 together with the wash water when the drain pump 80 pumps out the wash water, to the outside the pump case 82.

Meanwhile, a filter 96 of the drain pump 80 is disposed to be exposed through the front frame 10*a*. A user may easily replace the filter 96 by gripping the filter 96 exposed through the front frame 10*a*.

The drain hose 100 connects the lower side of the tub 20 to the drain pump 80 such that the water contained in the tub 20 is introduced into the drain pump 80. The drain hose 100 includes a first connection part 110, a second connection part 120, a wrinkled part 130, and a cross section reducing part 150. The first connection part 110 is connected to a lower end of the tub 20 to guide the wash water contained in the tub 20 such that the wash water is introduced into the inside the drain hose 100. The second connection part 120 is provided at an opposite end of the first connection 110 and is connected to the wash water inlet port 88 such that the wash water contained in the drain hose 100 is guided to be moved to the drain pump 80. The wrinkled part 130 is provided between the first connection part 110 and the second connection part 120 to absorb the vibration generated from the drain pump 80 or the tub 20. The cross section reducing part 150 is provided between the second connection part 120 and the wrinkled part 130 to reduce the abnormal noise that is generated from the drain hose 100.

An inner circumferential surface of the first connection part 110 is inserted around an outer circumferential surface of a hose connection part 22 that is formed at the lower end of the tub 20. An inner circumferential surface of the second connection part 120 is inserted around an outer circumferential surface of the wash water inlet port 88.

The first connection part 110 has a diameter (D1) equal to or larger than a diameter (D2) of the second connection part 120. The drain hose has a diameter gradually decreasing from the first connection part 110 to the second connection part 120 such that the wash water smoothly flows inside the drain hose 100.

In order for the second connection part 120 to be fixed and attached to the wash water inlet port 88 while preventing water leakage between the second connection part 120 and the wash water inlet port 88, a clamp 180 is coupled to an outer circumferential surface of the second connection part 120 in a state that the second connection part 120 is connected to the wash water inlet port 88. The detailed description of the clamp 170 will be made later.

The wrinkled part 130 has an outward appearance including a crest 132 and a trough 134 that are alternately disposed. The crest 132 and the trough 134 allow the outward appearance of the wrinkled part 130 to be easily deformed when external energy, such as vibration, is transferred to the wrinkled part 130, so that the external energy is effectively absorbed while passing through the crest 132 and the trough 134.

The cross-section reducing part 150 is configured to reduce the abnormal noise generated from the drain hose 100 by reducing the cross section of a passage at a certain area of the drain hose 100 to disturb the flow of air passing through the passage. With respect to a direction of the wash water flowing from the first connection part 110 to the second connection part 120, the cross section reducing part 150 includes a first inclined part 152, which is inclined in a manner to decrease a cross section of the drain hose 100, a second inclined part 154, which is inclined to an approximate opposite side to the inclination of the first inclined part 152 in a manner to increase a cross section of the drain hose 100, and a planar surface 156 formed between the first inclined part 152 and the second inclined part 154.

Such a cross section reducing part 150 is provided in the form of a concave obtained by concaving a portion of an upper side of the drain hose 100, which is divided in symmetric to a lower side of the drain hose 100 with respect to a curved surface (P1), in a radial direction of the drain hose 100 or in the direction of gravity by a predetermined length. In detail, as shown in FIG. 5, the cross section reducing part 152 is provided in the form of a concave obtained by concaving a portion of the upper side of the drain hose 100 in a direction perpendicular to the direction in which the wash water flows from the first connection part 100 to the second connection part 120.

A cross section (A1) of a portion of the drain hose 100, in which the cross section reducing part 150 is formed, is horizontally asymmetric with respect to the curved surface (P1), which horizontally passes through a center of a cross section (A2) of a portion of the drain hose 100 at the time when the cross section reducing part 150 is not formed.

The drain hose 100 is provided at an inner side with a wash water passage 102 and an air passage 104. The wash water passage 102 allows the wash water or moisture, which is separated from laundry during a drain operation or a spin-dry operation, to be introduced thereinto and flow therethrough. The air passage 104 is formed at an upper side of the wash water passage 102 to allow the air contained in the tub 20 or in the drain pump 82 to be introduced thereinto and flow therethrough. The cross section reducing part 150 divides the air passage 104 into a first air passage 104*a* and a second air passage 104*b* in cooperation with the wash water passage 102 to prevent the air, which is introduced from the tub 20 to the first air passage 104*a*, from flowing to the second air passage 104*b*, and to prevent the air, which is introduced from the pump case 82 to the second air passage 104*b*, from flowing to the first air passage 104*a*. That is, the cross section reducing part 150 serves as a blocking part to block the flow of the air inside the drain hose 100.

A height (H1) of the planar surface 156 is kept constant between the first inclined part 152 and the second inclined part 154. The height (H1) is set to be equal to or lower than a water level (H2) of the wash water flowing through the wash water passage 102. In this configuration, the air passage 104 is partitioned into the first air passage 104*a* and the second air passage 104*b* such that the first air passage 104*a* is prevented from communicating with the second air passage 104*b*. In addition, the air flow is blocked by the planar surface 156.

Since the planar surface 156 keeps its height (H1) constant between the first air passage 104*a* and the second air passage 104*b*, the first air passage 104*a* is stably divided and blocked from the second air passage 104*b* by the cross section reducing part 150. In order to stably divide the first air passage 104*a* from the second air passage 104*b*, the height (H1) of the planar surface 156 is set to be one fourth or greater and three fourth or less of the diameter (D2) of the second connection part 120 or a diameter of a portion of the drain hose 100 having the cross section reducing part 150.

As described above, the cross section reducing part 150 is formed at a predetermined portion of the drain hose 100, thereby preventing the abnormal noise that is caused when resonance or turbulence is generated from the drain hose 100.

The drain hose 100 is provided in the form of a pipe having two ends open, that is, having the first connection part 110 and the second connection part 120 open. Variables associated with a condition for generating a resonance in a pipe having two ends open include a frequency of an external noise source applied to the pipe and the length of a resonance pipe. For example, if the pipe is long, the frequency generating a resonance in the pipe is decreased, and if the pipe is short, the frequency generating a resonance in the pipe is increased.

When it is assumed that the drain hose 100 is considered as a pipe allowing air to flow therethrough and the tub 20 is considered as the external noise source in the washing machine 1, if a frequency of noise generated from the drain pump 80 or the tub 20 rotating is constant, the resonance may be prevented only by adjusting a length (L1) allowable for an air stream in the drain hose 100 in a manner to form a frequency band that is not matched to the frequency of noise generated from the drain pump 80 or the tub 20 rotating.

As described above, the cross section reducing part 150 partitions the air passage 104, which allows the air contained in the drain hose 100 to be introduced thereinto and flow therethrough, into the first air passage 104*a* and the second air passage 104*b* that are separated from each other, and such a partitioning of the air passage 104 changes the length of an air stream in the drain hose 100. That is, the cross sectional part 150 changes the length (L1) allowable for an air stream, which is obtained when the cross section reducing part 150 is not formed in the drain hose 100, to a length (L2) of the first air passage 104*a* or a length (L3) of the second air passage 104*b*.

The length (L2) of the first air passage 104*a* or the length (L3) of the second air passage 104*b* may be changed by the position in which the cross section reducing part 150 is formed on the drain hose 100 or the number of cross section reducing parts on the drain hose 100. Accordingly, if the frequency of the external noise source, such as a tub 20, causing a resonance inside the washing machine 1 is informed, the noise caused by a resonance is reduced by adjusting the position of placement or the number of the cross section reducing part 150.

In addition, wash water and air existing inside the tub 20 are introduced into and flow through the drain hose 100 through the first connection part 110 after being mixed with each other during the drain operation or the spin-dry operation. If the length travelled by the mixed wash water and air is large, the possibility of occurrence of turbulence is increased.

The cross section reducing part 150 blocks the flow of air introduced into the drain hose 100 through the first connection part 110 and allows only the wash water to flow toward the second connection part 120, so that the substantial distance travelled by the wash water and the air mixed with each other is reduced, thereby enabling the wash water to flow smoothly while reducing the abnormal noise caused by the turbulence due to a flow of the mixture of wash water and air.

Meanwhile, the drain hose 100 may be formed through injection molding including plastic having a superior vibration and noise insulation performance, such as T.P.E (Thermoplastic elastomer), T.P.O (Thermoplastic olefinic elastomer), T.P.U (Thermoplastic polyurethane), T.P.A.E (Thermoplastic polyamide), and T.P.E.E (Thermoplastic polyester elastomer), or rubber having a superior vibration and noise insulation performance, such as E.P.D.M (Ethylene propylene diene M-class). The drain hose 100 including such a plastic or rubber material is flexibly deformable, thereby effectively absorbing the vibration or noise energy generated from the drain pump 100.

Figure 6:
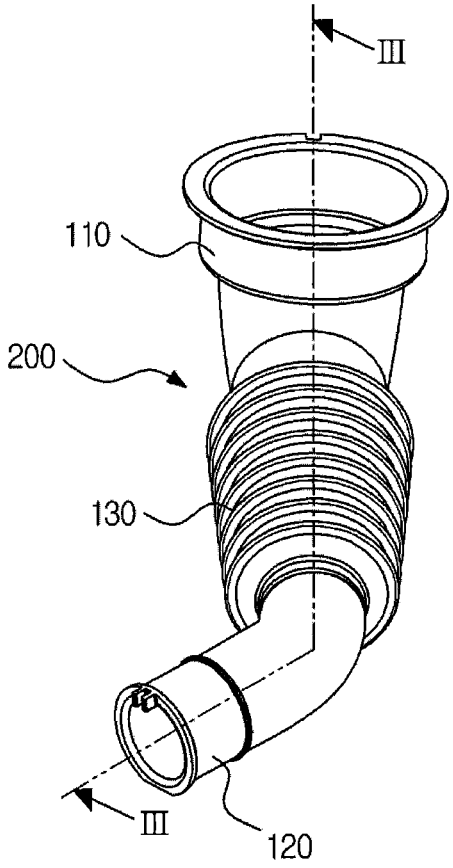
FIG. 6 is a perspective view illustrating a drain hose according to another embodiment of the present disclosure.
Figure 7:
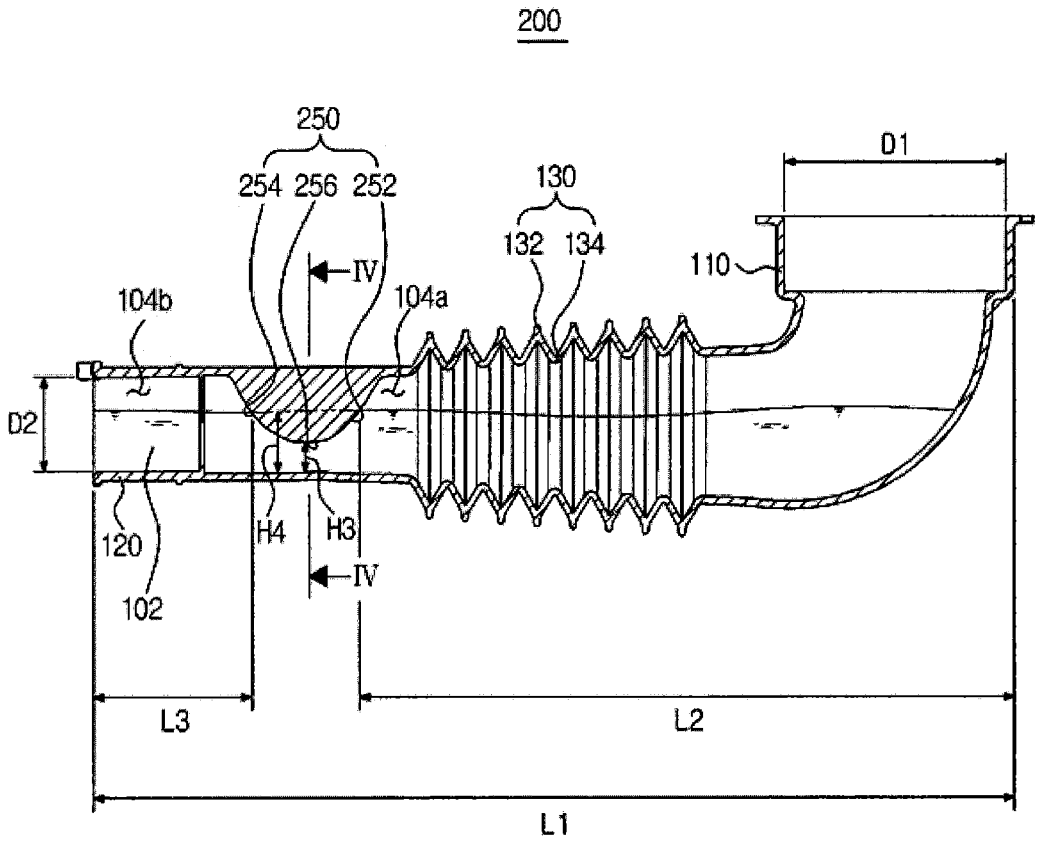
FIG. 7 is a cross-sectional view taken along line III-III of FIG. 6.
Figure 8:
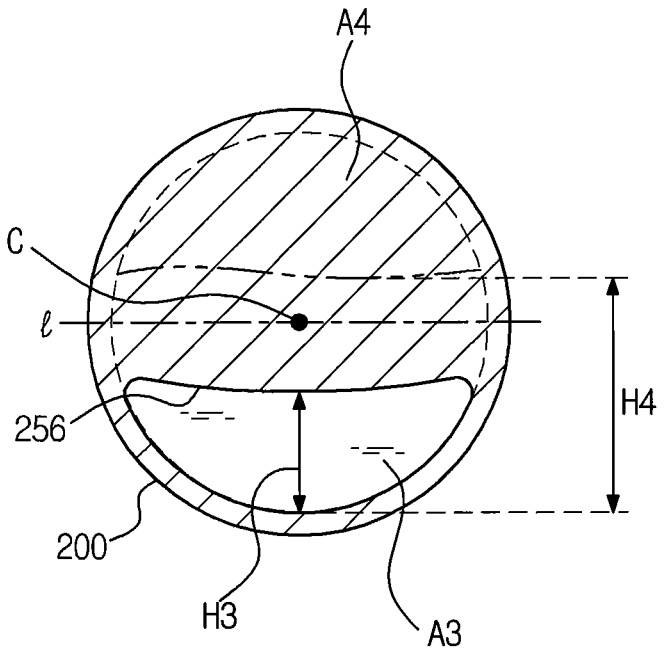
FIG. 8 is a cross-sectional view taken along line IV-IV of FIG. 7.

FIG. 6 is a perspective view illustrating a drain hose according to another embodiment of the present disclosure. FIG. 7 is a cross sectional view taken along a line III-III of FIG. 6. FIG. 8 is a cross sectional view taken along a line IV-IV of FIG. 7.

A drain hose 200 according to another embodiment of the present disclosure has the same configuration as the drain hose 100 according to the one embodiment of the present disclosure except for a partition 250. Accordingly, the description of the same reference numerals will be omitted since they are used to denote identical elements having the same functions throughout the drawings.

Referring to FIGS. 6 to 8, the drain hose 200 includes the partition 250 that is provided between the second connection part 120 and the wrinkled part 130 to reduce the abnormal noise generated from the drain hose 100.

The partition 250 is configured to reduce the cross section of a predetermined portion of a passage of the drain hose 200 to disturb the flow of air flowing in the passage. With respect to a direction of the wash water flowing from the first connection part 110 to the second connection part 120, the partition 250 includes a first inclined part 252, which is formed in an inclined manner to decrease a cross section of the drain hose 200, a second inclined part 254, which is formed to an approximate opposite side to an inclination of the first inclined part 252 in an inclined manner to increase a cross section of the drain hose 200, and a planar surface 256 formed between the first inclined part 252 and the second inclined part 254.

Such a partition 250 is provided by extending an inner circumferential surface of an upper side of the drain hose 200, which is divided in symmetric to a lower side of the drain hose 200 with respect to a curved surface (P2), in a radial direction of the drain hose 200 or in the direction of gravity by a predetermined length.

A cross section (A3) of a portion of the drain hose 200 having the partition 250 is horizontally asymmetric with respect to the curved surface (P2), which passes through a center of a cross section (A4) of a portion of the drain hose 200 without having the partition 250 in parallel to the ground.

The partition 250 divides the air passage 104, which is provided at the upper side of the wash water passage 102 into the first air passage 104*a* and the second air passage 104*b* in cooperation with the wash water passage 102. The partition 250 divides the air passage 104 into the first air passage 104*a* and the second air passage 104*b* to prevent the air, which is introduced from the tub 20 to the first air passage 104*a*, from flowing to the second air passage 104*b*, and prevents the air, which is introduced from the pump case 82 to the second air passage 104*b*, into the first air passage 104*a*.

A height (H3) of the planer part 256 is kept constant between the first inclined part 152 and the second inclined part 154. The height (H3) is set to be equal to or lower than a water level (H4) of the wash water flowing through the wash water passage 102. In this configuration, the first air passage 104*a* and the second air passage 104*b* are divided by the partition 250 to prevent the first air passage 104*a* and the second air passage 104*b* from communicating with each other, and the air flow is blocked by the planar surface 256.

Since the planar surface 256 keeps its height (H3) constant between the first air passage 104*a* and the second air passage 104*b*, the first air passage 104*a* is stably divided and blocked from the second air passage 104*b* by the partition 250. In order to stably divide the first air passage 104*a* from the second air passage 104*b*, the height (H3) of the planar surface 156 is set to be one fourth or greater and three fourth or less of the diameter (D2) of the second connection part 120 or a diameter of a portion of the drain hose 200 having the partition 250.

As described above, the partition 250 is formed at a predetermined portion of the drain hose 200, thereby preventing the abnormal noise that is caused when resonance or turbulence is generated from the drain hose 200. A mechanism of preventing the abnormal noise is identical to that according to the previous embodiment. Therefore, detailed description of the mechanism of preventing the abnormal noise will be omitted.

Figure 9A:
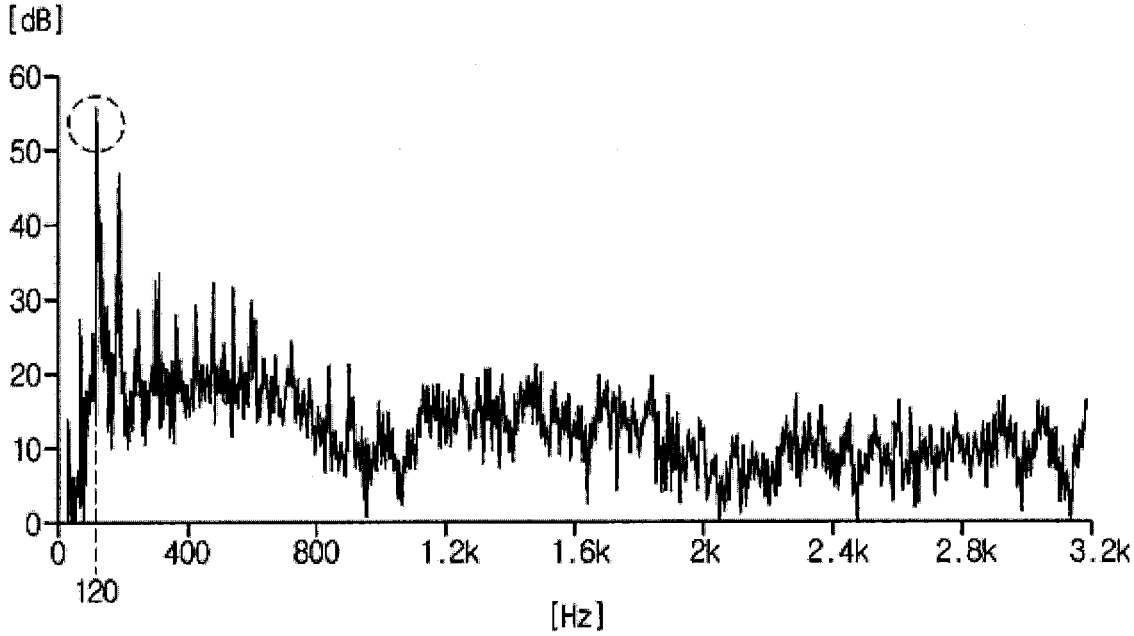
FIGS. 9A and 9B are graphs showing the noise of a spin-dry operation without using the drain hose, and the noise generated during a spin-dry operation using the drain hose according to the embodiment of the present disclosure, respectively.
Figure 9B:
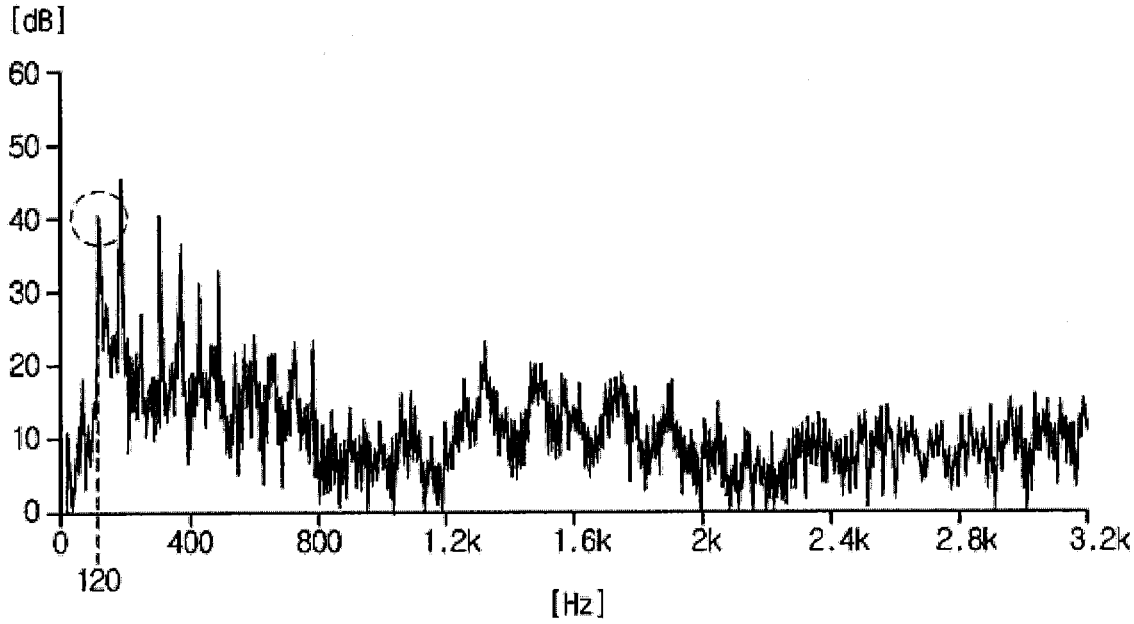

FIG. 9A is a graph showing the noise of a spin-dry operation without using the drain hose, and FIG. 9B is a graph showing the noise generated during a spin-dry operation using the drain hose according to the embodiment of the present disclosure. The horizontal axis of the graphs represents a frequency (Hz) of noise caused by vibration of the drain pump 100, and the vertical axis of the graphs represents noise (dB) according to frequency (Hz).

Referring to FIGS. 9A and 9B, the noise generated when a spin-dry operation is performed using the drain hose 100 including the cross section reducing part 150 is smaller than the noise generated using a general drain hose without having the cross section reducing part 150. Noise at a frequency of 120 Hz corresponds to an abnormal noise generated from the drain hose 100. For the frequency 120 Hz, the noise at a spin-dry operation using the drain hose 100 is significantly reduced by 15 dB or above as compared with the noise generated from a spin-dry operation without using the drain hose 100. It is proven that the resonance or the turbulence causing the abnormal noise does not occur in the drain pump 100.

Although not shown, the cross section reducing part 150 or the partition 250 may be applied not only to a drum type washing machine but also to a full automatic washing machine having a pulsator, in which the cross section reducing part 150 or the partition 250 may be coupled to a drain pump to reduce the noise.

Figure 10A:
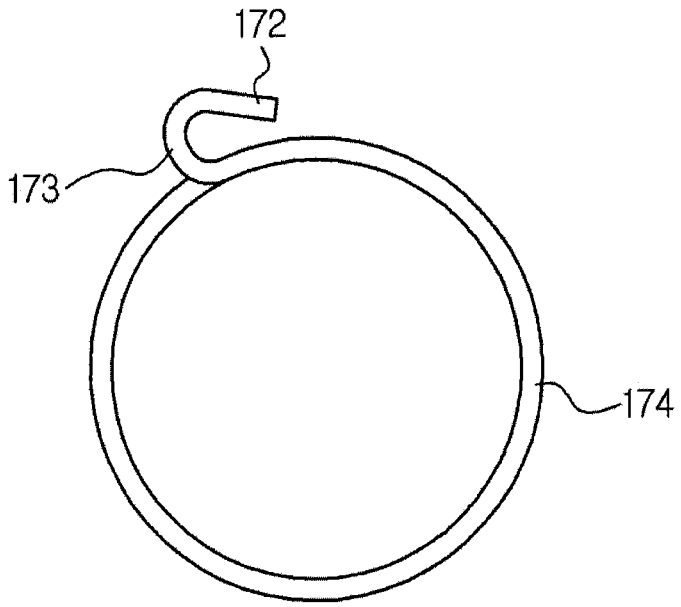
FIGS. 10A and 10B illustrate a front side view and a rear side view of a clamp of FIG. 3.
Figure 10B:
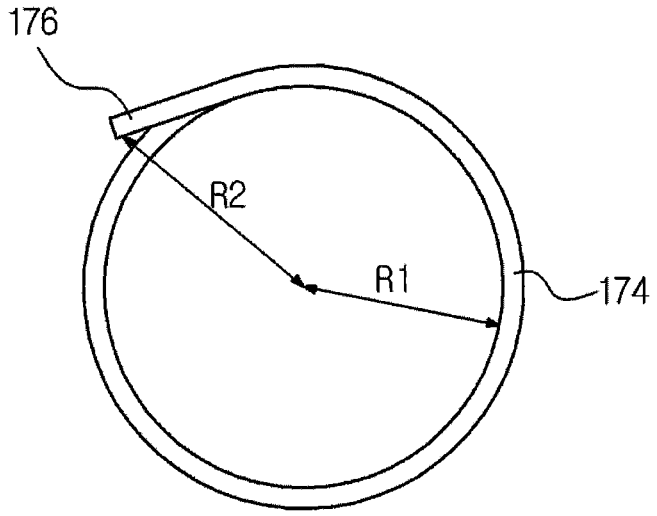
Figure 11:
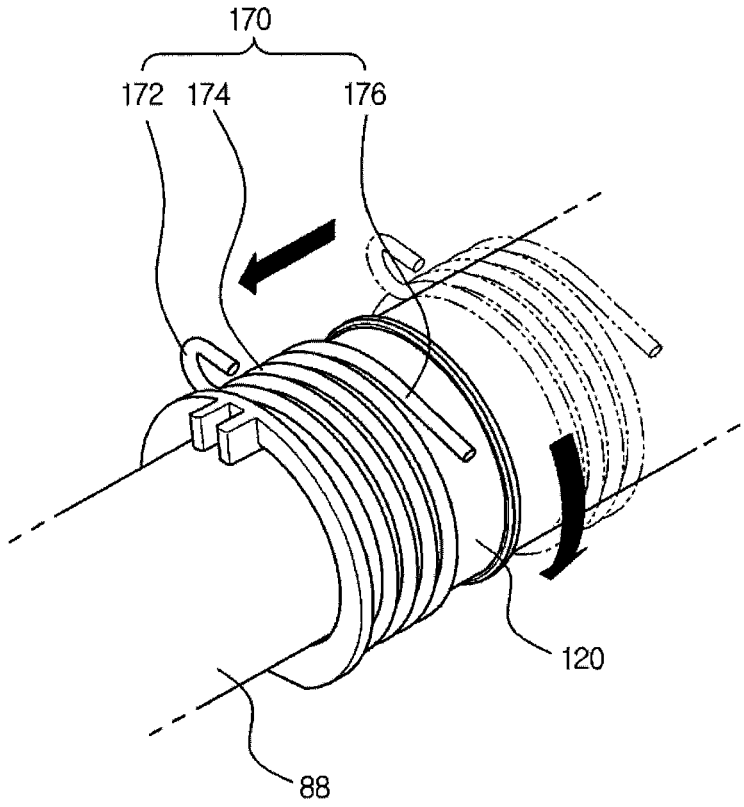
FIG. 11 is a view illustrating a process of fixedly having the drain hose come into close contact with the drain pump.

FIGS. 10A and 10B illustrate a front side view and a rear side view of a clamp of FIG. 3. FIG. 11 is a view illustrating a process of fixedly attaching the drain hose to the drain hose such that the drain hose comes into close contact with the drain pump.

Referring to FIGS. 3, 10, and 11, the clamp 170 includes a handle part 172, to which an external force is applied by an operator, a coil part 174 connected to the handle part 172 to elastically press the drain hose 100 in a radial direction of the drain hose 100, and an extension part 176 extending from one end of the coil part 174.

An end of the handle part 172 is provided in the form of a hook. The handle part 172 is provided with a pressing surface 173 which is pressed by an external force. If a force is applied to the pressing surface 173, the handle part 172 moves while rotating in a direction to which the handle part 172 is pressed, so that the diameter of the clamp 170 increases. If the force applied to the pressing surface 173 is released, the handle part 172 moves while rotating opposite to the direction to which the handle part 172 is pressed, the diameter of the clamp 170 decreases.

The coil part 174 includes an elastic member, such as a coil spring. The coil part 174 elastically presses the second connection part 120 while coming into contact with the second connection part 120 such that an outer circumferential surface of the wash water inlet port 88 and an inner circumferential surface of the second connection part 120 are coupled to each other while coming into contact with each other. Accordingly, water leakage on a connecting portion between the drain hose 100 and the pump case 82 is prevented.

The extension part 176 extends from one end of the coil part 174 in a predetermined length in a tangential direction of the coil winding. Referring to FIG. 10B, a distance (R2) between a terminating end of the extension part 176 and the center of the coil part 174 is larger than a radius (R1) of the coil part 174. The extending of the extension part 176 in the tangential direction of the coil part 174 prevents the outer circumferential surface of the drain hose 100 from being damaged by the extension part 176 in a process of coupling the drain hose 100 to the pump case 83 by use of the clamp 170.

Referring to FIG. 11, a process of fixing the drain hose 100 to the pump case 82 is as follows. First, the clamp 170 is disposed on the outer circumferential surface of the second connection part 120 of the drain hose 100, and then the second connection part 120 is coupled to the wash water inlet port 88 of the pump case 82. Thereafter, in a state that the diameter of the clamp 170 is increased as a pressing force is applied to the pressing surface 173 of the handle part 172, the clamp 170 is rotated to be linearly moved in a direction coupling the drain hose 100 to the pump case 82. Finally, if the pressing force is released from the pressing surface 174, the diameter of the clamp 170 is decreased such that the clamp 170 is fixedly attached to the outer circumferential surface of the drain hose 100.

Although not shown, the clamp 170 may be used for fixing a general hose in addition to the drain hose 100.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A washing machine comprising:

a cabinet;

a tub disposed inside the cabinet to accommodate wash water;

a drain pump disposed at a lower side of the tub to drain the wash water contained in the tub;

a horizontally-extending first drain hose connecting the tub to the drain pump to allow the wash water contained in the tub to be introduced into the drain pump; and a second drain hose guiding the wash water, which is introduced into the drain pump, to outside the cabinet, wherein the first drain hose comprises a passage allowing wash water and air to pass therethrough;

a cross section reducing part configured to reduce a cross section of the passage to disturb a flow of the air passing through the passage;

a first connection part connected to the tub;

a second connection part connected to the drain pump; and a wrinkled part provided between the first connection part and the second connection part, wherein the cross section reducing part is formed between the wrinkled part and the second connection part, wherein the cross section reducing part divides the air passage into at least two separate air passages and is configured to prevent air from communicating with the separate air passages.

2. The washing machine of claim 1, wherein the first drain hose is provided at an inner side with a wash water passage, which allows the wash water contained in the tub to be introduced thereinto and flow therethrough, and the air passages, which are formed at an upper side of the wash water passage to allow air contained in the tub or the drain pump to be introduced thereinto and flow therethrough.

3. The washing machine of claim 2, wherein the air passages comprises:

a first air passage allowing the air contained in the tub to be introduced thereinto; and a second air passage allowing the air contained in the drain pump to be introduced thereinto, wherein the cross section reducing part blocks the first air passage from the second air passage to prevent the first air passage from communicating with the second air passage.

4. The washing machine of claim 3, wherein a portion of the first drain hose, on which the cross section reducing part is formed, has a cross section horizontally asymmetric with respect to a center line, which passes through a center of a cross section of a remaining portion of the first drain hose in parallel to a ground.

5. The washing machine of claim 3, wherein the cross section reducing part is formed at a position nearer to the second connection part than the first connection part.

6. The washing machine of claim 5, wherein the cross section reducing part has a concave form obtained by concaving a portion of an upper side of the first drain hose, which is divided in symmetric to a lower side of the first drain hose with respect to a curved surface, in a radial direction of the first drain hose.

7. The washing machine of claim 6, wherein the cross section reducing part comprises a planar surface having a constant height such that the first air passage and the second air passage are stably divided by the cross section reducing part.

8. The washing machine of claim 7, wherein the height of the planar surface is one fourth or greater and three fourths or less of a diameter of the second connection part.

9. The washing machine of claim 5, further comprising a clamp which is coupled to an outer circumferential surface of the second connection part to apply a pressing force, so that an inner circumferential surface of the second connection part is pressed against an outer circumferential surface of one end of the drain pump, while coming into close contact with the outer circumferential surface of the one end of the drain pump, wherein the clamp comprises a handle part provided with a pressing surface which is pressed by an external force;

a coil part connected to the handle part to press the second connection part in a radial direction of the first drain hose; and an extension part extending from one end of the coil part in a tangential direction of the coil part.

10. The washing machine of claim 9, wherein the coil part has a diameter which increases as a pressing force is applied to the handle part and decreases as a pressing force is released from the handle part.

11. The washing machine of claim 1, wherein the cross section reducing part is provided as a partition that extends downward from an inner circumferential surface of an upper side of the first drain hose, which is divided in symmetric to a lower side of the first drain hose with respect to a curved surface.

12. The washing machine of claim 11, wherein the cross section reducing part comprises a planar surface having a constant height such that the first air passage and the second air passage are stably divided by the cross section reducing part.

13. The washing machine of claim 12, wherein the height of the planar surface is one fourth or greater and three fourths or less of a diameter of the second connection part.

14. A washing machine comprising:

a cabinet, a tub disposed inside the cabinet, a drain pump disposed at a lower side of the tub, and a drain hose connecting the tub to the drain pump, wherein the drain hose comprises a first connection part connected to the tub and having a first diameter;

a second connection part connected to the drain pump and having a second diameter; and a groove part which is provided in a form of a concave obtained by concaving a portion of an upper side of the drain hose with respect to a curved surface, which connects the first diameter to the second diameter, to an inner side of the drain hose, wherein the groove part comprises a first inclined surface that is formed in an inclined manner to abruptly decrease a cross section of the drain hose;

a second inclined surface that is formed in an inclined manner to abruptly increase a cross section of the drain hose; and a planar surface formed between the first inclined surface and the second inclined surface while keeping a height constant, wherein a height of the planar surface is equal to or lower than a water level of wash water flowing through the drain hose whereby the at least two separate air passages are formed in the drain hose and the height of the planar surface prevents air from communicating between the separate air passages.

15. The washing machine of claim 14, wherein a cross section of a portion of the drain hose, in which the groove part is formed, is asymmetric with respect to the curved surface.

16. The washing machine of claim 15, wherein the groove part is formed at a position nearer to the second connection part than the first connection part.

17. The washing machine of claim 16, wherein the drain hose further comprises a wrinkled part provided between the first connection part and the second connection part, and wherein the groove part is formed between the wrinkled part and the second connection part.

18. The washing machine of claim 17, wherein the drain hose has a diameter gradually decreasing from the first connection part to the second connection part.

* * * * *

UNITED STATES PATENT AND TRADEMARK OFFICE

CERTIFICATE OF CORRECTION

PATENT NO. : 9,080,275 B2
APPLICATION NO. : 13/468540
DATED : July 14, 2015
INVENTOR(S) : Young Pil Park et al.

It is certified that error appears in the above-identified patent and that said Letters Patent is hereby corrected as shown below:

In the Claims

Col. 12, line 57, claim 9, delete "pump," and insert --pump--, therefor.

Col. 14, line 13, claim 14, delete "hose" and insert --hose,--, therefor.

Signed and Sealed this
Thirteenth Day of October, 2015

Michelle K. Lee

Michelle K. Lee
*Director of the United States Patent and Trademark Office*